US011058907B2

(12) United States Patent
Senecal

(10) Patent No.: US 11,058,907 B2
(45) Date of Patent: Jul. 13, 2021

(54) METHOD OF DELIVERING A FIRE EXTINGUISHING AGENT

(71) Applicant: Kidde-Fenwal Incorporated, Ashland, MA (US)

(72) Inventor: Joseph Senecal, Wellesley, MA (US)

(73) Assignee: KIDDE-FENWAL INCORPORATED, Ashland, MA (US)

( * ) Notice: Subject to any disclaimer, the term of this patent is extended or adjusted under 35 U.S.C. 154(b) by 581 days.

(21) Appl. No.: 14/779,388

(22) PCT Filed: Mar. 21, 2014

(86) PCT No.: PCT/US2014/031447
§ 371 (c)(1),
(2) Date: Sep. 23, 2015

(87) PCT Pub. No.: WO2014/160609
PCT Pub. Date: Oct. 2, 2014

(65) Prior Publication Data

US 2016/0059058 A1 Mar. 3, 2016

Related U.S. Application Data

(60) Provisional application No. 61/806,030, filed on Mar. 28, 2013.

(51) Int. Cl.
*A62C 35/02* (2006.01)
*A62C 99/00* (2010.01)

(52) U.S. Cl.
CPC ..... *A62C 35/023* (2013.01); *A62C 99/0018* (2013.01); *A62C 99/0072* (2013.01)

(58) Field of Classification Search
CPC ..... A62C 35/023; A62C 99/0018; A62C 99/0072; A62C 31/05; A62C 31/02
(Continued)

(56) References Cited

U.S. PATENT DOCUMENTS 3,949,812 A 4/1976 Hay
4,436,160 A 3/1984 Ragailler
(Continued)

FOREIGN PATENT DOCUMENTS

CN 102366660 A 3/2012
CN 202158879 U 3/2012
(Continued)

OTHER PUBLICATIONS

Notification of Transmittal of the International Search Report for International Application No. PCT/US2014/031447 dated Nov. 28, 2014; dated Dec. 4, 2014; 4 pages.
(Continued)

*Primary Examiner* — Joseph A Greenlund
(74) *Attorney, Agent, or Firm* — Cantor Colburn LLP

(57) ABSTRACT

A fire suppression system is provided including at least one nozzle configured to expel a fire suppression agent into a space. A storage container includes a fire suppression agent and a first pressurized gas at least partially dissolved within the fire suppression agent. At least one canister contains a second pressurized gas. A piping system is configured to fluidly couple the at least one canister to the storage container and to fluidly couple the storage container to the at least one nozzle. When the fire suppression system is inactive, the fire suppression agent within the storage container is pressurized to a storage pressure. The storage pressure is greater than a vapor pressure of the fire suppression agent such that first pressurized gas dissolves into the fire suppression agent. When the fire suppression system is active, propellant pressure in the piping system exceeds the storage pressure of the fire suppression agent.

20 Claims, 2 Drawing Sheets

(58) Field of Classification Search
USPC ..... 169/47, 9; 3/47, 9
See application file for complete search history.

(56) References Cited

U.S. PATENT DOCUMENTS

| | | | | |
|---|---|---|---|---|
| 4,622,209 | A | 11/1986 | Nardi et al. | |
| 5,562,235 | A | 10/1996 | Cruysberghs | |
| 5,845,714 | A | 12/1998 | Sundholm | |
| 5,899,275 | A * | 5/1999 | Okamoto | F16K 1/303 169/20 |
| 5,934,380 | A | 8/1999 | Finnerty et al. | |
| 5,996,699 | A * | 12/1999 | Sundholm | A62C 35/023 169/9 |
| 6,016,874 | A * | 1/2000 | Bennett | A62C 5/006 169/77 |
| 6,112,822 | A * | 9/2000 | Robin | A62C 35/023 169/46 |
| 6,346,203 | B1 | 2/2002 | Robin et al. | |
| 6,763,894 | B2 * | 7/2004 | Schoenrock | A62C 31/02 169/11 |
| 8,360,162 | B2 * | 1/2013 | Lelic | A62C 99/0072 169/16 |
| 2002/0027143 | A1 * | 3/2002 | Schoenrock | A62C 31/02 222/209 |
| 2005/0001065 | A1 * | 1/2005 | Senecal | A62C 35/023 239/461 |
| 2005/0173131 | A1 * | 8/2005 | Dunster | A62C 99/0072 169/44 |
| 2011/0259617 | A1 * | 10/2011 | Lelic | A62C 31/05 169/46 |
| 2014/0202719 | A1 * | 7/2014 | Senecal | A62C 13/68 169/46 |
| 2016/0059058 | A1 * | 3/2016 | Senegal | A62C 99/0072 169/47 |

FOREIGN PATENT DOCUMENTS

| | | | |
|---|---|---|---|
| EP | 1454658 | A1 | 9/2004 |
| WO | 2010071622 | A1 | 6/2010 |

OTHER PUBLICATIONS

Written Opinion of the International Searching Authority for International Application No. PCT/US2014/031447 dated Nov. 28, 2014; dated Dec. 4, 2014; 4 pages.

PCT International Preliminary Report on Patentability; International Application No. PCT/US2014/031447; International Filing Date: Mar. 21, 2014; dated Sep. 29, 2015; pp. 1-6.

* cited by examiner

METHOD OF DELIVERING A FIRE EXTINGUISHING AGENT

CROSS-REFERENCE TO RELATED APPLICATION

This application claims the benefit of U.S. provisional patent application Ser. No. 61/806,030 filed Mar. 28, 2013, the entire contents of which are incorporated herein by reference.

BACKGROUND OF THE INVENTION

The invention relates generally to gaseous-agent fire suppression systems that employ fire suppression fluids that vaporize upon discharge into the air of a protected space and, more particularly, to a method of supplying a fire suppression fluid to a protected space.

Fire suppression systems are known, and include the use of any of a variety of fire suppressing agents that are generally discharged towards a fire. The effectiveness of a fire suppression system is dependent on multiple factors, in particular, the momentum of the expelled stream of an agent, and the rate at which the liquid portion of the agent is atomized when discharged. A high momentum promotes atomization of the liquid agent and promotes air circulation, thereby facilitating the creation of a uniformly distributed fire extinguishing air-agent atmosphere. Atomization of the liquid agent expelled from the nozzle may be enhanced if the liquid agent on the high pressure side of the nozzle contains a dissolved gas. Upon ejection of a liquid agent containing a dissolved gas into ambient air, the dissolved gas rapidly out-gases from the liquid phase, causing the liquid droplets to break up into smaller droplets. Small droplets evaporate more quickly as a result of an increase in specific surface area available for evaporative heat and mass transfer with the ambient atmosphere.

Stored-pressure fire suppression systems typically store the liquid agent within a container pressurized with nitrogen to at least 360 pounds per square inch (psig). Some of the nitrogen dissolves into the agent, however, the concentration of dissolved nitrogen in the liquid phase depends on the local pressure and temperature. Upon discharge, the nitrogen-saturated liquid flows through the pipe system. The local pressure decreases from the stored pressure relative to both time and distance from the storage container. At pressures lower than the storage pressure, some of the nitrogen will bubble out of the liquid, creating a two-phase flow. The two-phase mixture has lower density and flows at a higher velocity than the liquid phase, thereby resulting in a greater frictional pressure loss per unit length of pipe. This effect is counter to the goal of achieving maximum pressure at the nozzle when the agent is discharged.

BRIEF DESCRIPTION OF THE INVENTION

According to an aspect of the invention, a fire suppression system is provided including at least one nozzle configured to expel a fire suppression agent into a space. A storage container includes a fire suppression agent and a first pressurized gas at least partially dissolved within the fire suppression agent. At least one canister contains a second pressurized gas. A piping system is configured to fluidly couple the at least one canister to the storage container and to fluidly couple the storage container to the at least one nozzle. When the fire suppression system is inactive, the fire suppression agent within the storage container is pressurized to a storage pressure. The storage pressure is greater than a vapor pressure of the fire suppression agent such that first pressurized gas dissolves into the fire suppression agent. When the fire suppression system is active, the propellant pressure in the piping system is generally greater than the storage pressure of the fire suppression agent.

Alternatively, in this or other aspects of the invention, when the fire suppression system is active, the pressurized fire suppression agent and the first pressurized gas at least partially dissolved within the pressurized fire suppression agent flow through the piping system in a substantially single-phase flow.

Alternatively, in this or other aspects of the invention, the first pressurized gas and the second pressurized gas may be one of nitrogen, argon, carbon dioxide, or a mixture thereof.

Alternatively, in this or other aspects of the invention, the fire suppression agent may be one of FK-5-1-12, 1,1,1,2,2,4,5,5,5-nonafluoro-4-(trifluoromethyl)-3-pentanone ($CF_3CF_2C(=O)CF(CF_3)_2$), CAS 756-13-6; HFC-227ea, 1,1,1,2,3,3,3-heptaflurorporpane ($CF_3CHFCF_3$), CAS 431-89-0; HFC-125, 1,1,1,2,2-pentafluoroethane, CAS 354-33-6; HFC-236fa, 1,1,1,2,2,2-hexafluoropropane ($CF_3CHFCF_2H$), CAS 690-39-1.

Alternatively, in this or other aspects of the invention, the storage pressure of the fire suppression agent is between about 1 psig and about 250 psig.

Alternatively, in this or other aspects of the invention, the storage pressure of the fire suppression agent is between about 20 psig and about 150 psig.

Alternatively, in this or other aspects of the invention, the piping system further includes a first pipe extending between the storage container and the at least one nozzle. The first pipe includes a first valve. A second pipe extends between the at least one canister and the storage container. The second pipe includes a second valve.

Alternatively, in this or other aspects of the invention, the first valve and the second valve are substantially closed when the fire suppression system is inactive.

Alternatively, in this or other aspects of the invention, the first valve and the second valve are substantially open when the fire suppression system is active.

Alternatively, in this or other aspects of the invention, the fire suppression system further includes a fire detection device configured to detect a fire. A controller is operably coupled to the fire detection device, and the first valve and second valve. The controller is configured to operate the first valve and the second valve in response to a signal from the fire detection device indicating a fire.

According to yet another aspect of the invention, a method of extinguishing a fire using a fire suppression system is provided including storing a fire suppression agent within a storage container at a storage pressure such that a first pressurized gas is at least partially dissolved within the fire suppression agent. A second pressurized gas is similarly stored within at least one canister. Upon detection of a fire, at least one valve in a piping system of the fire suppression system is operated. A propellant pressure is created in the piping system such that the fire suppression agent having the first pressurized gas partially dissolved therein flows through the piping system to at least one nozzle of the fire suppression system. The propellant pressure is generally greater than the storage pressure of the fire suppression agent.

Alternatively, in this or other aspects of the invention, the storage pressure is greater than a vapor pressure of the fire suppression agent.

Alternatively, in this or other aspects of the invention, the fire suppression agent and the first pressurized gas at least partially dissolved within the fire suppression agent flow through the piping system to the at least one nozzle in a substantially single-phase flow.

Alternatively, in this or other aspects of the invention, the piping system fluidly coupled the at least one canister to an inlet of the storage container. The piping system also fluidly couples an outlet of the storage container to the at least one nozzle.

Alternatively, in this or other aspects of the invention, at least one fire detection device is configured to emit a detection signal in response to a fire.

Alternatively, in this or other aspects of the invention, a controller is operably coupled to the at least one fire detection device and the at least one valve. The controller is configured to operate the at least one valve in response to receiving the detection signal from the at least one fire detection device.

Alternatively, in this or other aspects of the invention, operation of the at least one valve releases the second pressurized gas into the piping system to generate a propellant pressure.

According to another aspect of the invention, a method of reducing an amount of two-phase flow of a fire suppression agent and a first pressurized gas provided to at least one nozzle of a fire suppression system is provided including storing a fire suppression agent within a storage container at a storage pressure such that a first pressurized gas is at least partially dissolved within the fire suppression agent. A propellant pressure is generated in a piping system coupling the storage container to the at least one nozzle. The propellant pressure moves the fire suppression agent and the first pressurized gas at least partially dissolved within the fire suppression agent towards the at least one nozzle. The propellant pressure is generally greater than the storage pressure of the fire suppression agent. At least a portion of the first pressurized gas remains dissolved within the fire suppression agent when the fire suppression agent reaches the at least one nozzle.

Alternatively, in this or other aspects of the invention, the fire suppression agent and the first pressurized gas at least partially dissolved within the fire suppression agent flow through the piping system to the at least one nozzle in a substantially single-phase flow.

Alternatively, in this or other aspects of the invention, the storage pressure is greater than a vapor pressure of the fire suppression agent.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
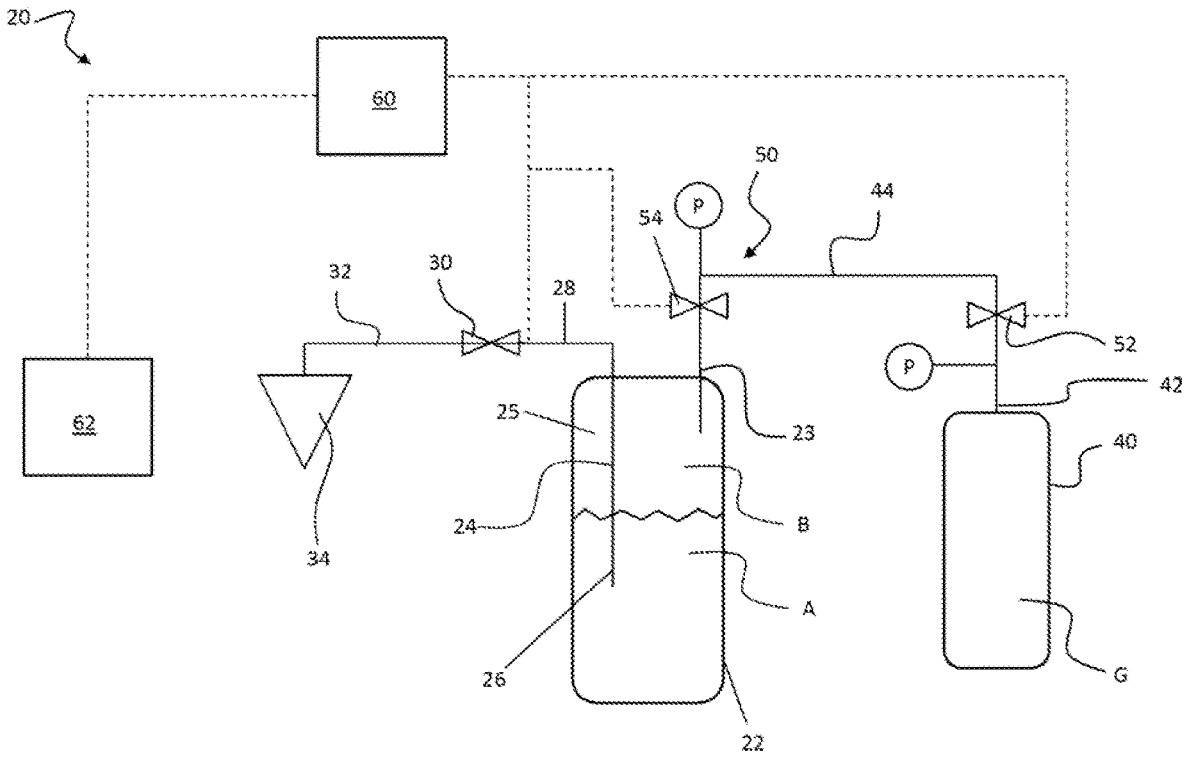
FIG. 1 is a schematic illustration of a fire suppression system for delivery a fire suppression agent according to an embodiment of the invention.
Figure 2:
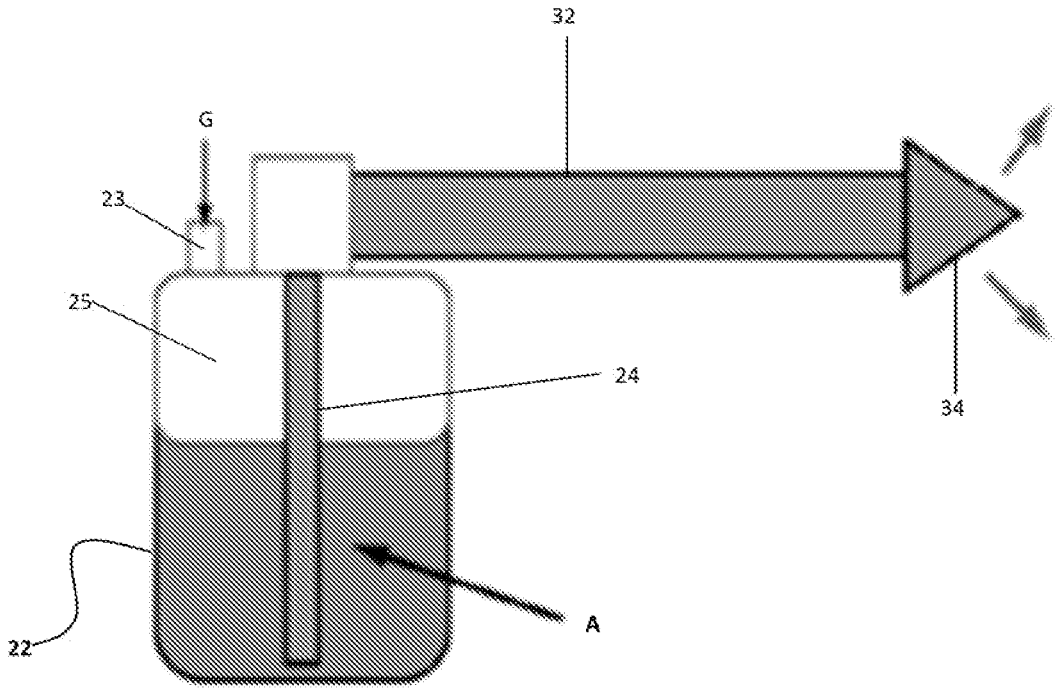
FIG. 2 is a detailed side view of an agent-storage container of the fire suppression system of FIG. 1.

Referring now to the FIGS., a fire suppression system 20 for delivering a fire suppression agent A to a space where a fire is detected is illustrated. The fire suppression system 20 includes a storage container 22 containing a fire suppression agent A. A first end 26 of a dip tube 24 is arranged within the storage container 22 and a second end 28 of the dip tube 26 is coupled to a valve 30. A first conduit or pipe 32 fluidly couples the valve 30 to one or more delivery nozzles 34 such that together, the first pipe 32 and the dip tube 24 create a flow path for the fire suppression agent A from the storage container 22 to the at least one nozzle 34.

One or more canisters 40 configured to store a gas G under pressure are coupled to the storage container 22. Exemplary gases G within the at least one canister 40 include, but are not limited to, nitrogen, argon, carbon dioxide, mixtures of these gases, or other inert gases or high vapor pressure chemicals for example. Each canister 40 of pressurized gas G is fluidly coupled, such as with a second pipe 44 for example, to an inlet 23 of the storage container 22. Together, the first pipe 32 and second pipe 44 form a piping system 50 configured to supply pressurized gas G to the storage container 22 and fire suppression agent A to the nozzles 32. A valve 52 may be arranged adjacent the outlet 42 of each canister 40 to control the amount of gas G provided from each canister 40 into pipe 44. Similarly, another valve 54 may be positioned adjacent to the inlet 23 of the storage container 22 to control the amount of the pressurized gas G flowing into the storage container 22. In addition, a plurality of pressure gauges P or other, similar devices may be used or arranged at various locations, such as adjacent the inlet 23 of the storage container 22, or adjacent the outlet 42 of each canister 40 for example, to monitor the pressure within the fire suppression system 20.

A control device 60, such as a controller for example, is configured to communicate with at least one fire detection device 62, such as a conventional fire detector or fire sensor for example. The fire detection device 62 may be directly connected to the controller 60, such as with a wire for example, or may be configured to communicate with the control device 60 wirelessly. The control device 60 may also be operably coupled to each of the plurality of valves 30, 52, 54 within the piping system 50.

Exemplary fire suppression agents A suitable for use in accordance with various embodiments of the present invention include, but are not limited to, compounds selected from the chemical compound classes of hydrofluorocarbons, iodofluorocarbons, and fluorinated ketones. Specific hydrofluorocarbons may, but need not include, pentafluoroethane ($CF_3CF_2H$), 1,1,1,2-tetraflurorethane ($CF_3CH_2F$), 1,1,1,2,3,3,3-heptaflurorporpane ($CF_3CHFCF_3$), 1,1,1,2,2,3,3-heptafluoropropane ($CF_3CF_2CF_2H$), 1,1,1,2,2,2-hexafluoropropane ($CF_3CHFCF_2H$), 1,1,2,2,3,3-hexafluoropropane ($HCF_2CF_2CF_2H$), and 1,1,1,2,2,3-hexafluoropropane ($CF_3CF_2CH_2F$) for example. Exemplary iodofluorocarbons include, but are not limited to iodotrifluoromethane ($CF_3I$). In one embodiment, the fire suppression agent A is FK-5-1-12, 1,1,1,2,2,4,5,5,5-nonafluoro-4-(trifluoromethyl)-3-pentanone ($CF_3CF_2C(=O)CF(CF_3)_2$), CAS 756-13-6, often identified under the trademark Novec™ 1230, registered to 3M™ of Saint Paul, Minn.

When the fire suppression system 20 is inactive, the liquid fire suppression agent A within the storage container 22 is generally pressurized with a first pressurizing gas B. Exemplary gases B used to pressurize the liquid fire suppression agent A within the storage container 22 include, but are not limited to, nitrogen, argon, carbon dioxide, mixtures of these gases, or other inert gases or high vapor pressure chemicals for example. In one embodiment, the agent A is superpressurized to a storage pressure such that the storage pressure of container 22 is greater than a vapor pressure of the fire suppression agent A contained therein. The maximum allowable storage pressure of the liquid fire suppression agent A within the container 22 is generally less than the pressure at each of the plurality of nozzles 34. At this storage pressure, the pressurized gas B at least partially dissolves into the liquid fire suppression agent A. The storage pressure within the storage container 22 when the fire suppression system 20 is inactive is generally in the range of about 1 pound per square inch (psig) to about 250 psig, and more particularly in the range of about 20 psig to about 150 psig. In one embodiment, the storage pressure in the inactive storage container 22 is approximately 70 psig.

Upon detection of a fire event by a fire detection device 62, such as smoke or flame detectors for example, the control device 60 will operate at least one of the plurality of valves 30, 52, 54 in the fire suppression system 20. Such sensing and controlling is known in the fire suppression art and is used to detect the presence of a fire and then initiate operation of the fire suppression system 20. In the illustrated system, the detection of a fire event acts as a trigger for the control device 60 to operate the valves 30, 52, 54 and deliver additional pressurized gas G to the storage container 22.

Operation of valves 52 and 54 to a generally open position allows the pressurized gas G within a respective canister 40 to flow freely through piping 44 into the storage container 22. The control device may 60 operate valve 30 at the same time or shortly after operating valves 52, 54 such that the liquid fire suppression agent A within the storage container 22 may be supplied to the delivery nozzles 34. With valve 30 open, the propellant pressure created by the pressurized gas G entering into ullage space 25 of the storage container 22 causes the liquid fire suppression agent A to flow through the coupled dip tube 24 and pipe 32 to the nozzles 34. In one embodiment, the propellant pressure used to move the saturated fire suppression agent A through the piping system 50 is greater than the storage pressure of the fire suppression agent A. Because the propellant pressure is greater than the storage pressure of the liquid fire suppression agent A, the gas B initially in the storage container 22, and partially dissolved in the fire suppression agent A, remains dissolved therein until the fire suppression agent A is expelled from at least one of the plurality of nozzles 34. Upon discharge, the gas B partially dissolved in agent A is fully available to outgas from the liquid agent A to facilitate droplet atomization and suppress a fire.

Because fire suppression agent is initially "lightly" superpressurized with inert gas B and because the pressure loss within the fire suppression system is low, the liquid agent A having dissolved inert gas B therein will flow to the at least one nozzle 34 as a substantially single-phase flow. By maintaining the state of the dissolved inert gas B within the fire suppression agent A, the atomization of the agent A is facilitated as the agent A is expelled from the nozzle 34. By maintaining a substantially single-phase flow of fluid in pipe 32, the gradient of frictional pressure loss along the length of pipe 32 in the fire suppression system may be reduced while maintaining the desired minimum pressure at the nozzle 34. This reduction in frictional pressure loss allows the overall length of pipe in a given fire suppression system 10. As a result, a given fire suppression system may be large, simplified, and more cost effective than conventional systems.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fire suppression system comprising:

at least one nozzle configured to expel a fire suppression agent into a space;

a storage container including the fire suppression agent in a liquid state and a first pressurized gas at least partially dissolved within the fire suppression agent, the first pressurized gas being distinct from the first suppression agent;

at least one canister containing a second pressurized gas;

a piping system configured to fluidly couple the at least one canister to the storage container, and to fluidly couple the storage container to the at least one nozzle, the piping system including a valve disposed between the at least one canister and the storage container, the valve being adjustable to control a flow between the at least one canister and the storage container; and wherein the fire suppression system is transformable between an inactive state and an active state by adjusting the valve, wherein when the fire suppression system is in the inactive state, a storage pressure of the storage container greater than a vapor pressure of the fire suppression agent and at least a portion of the first pressurized gas is dissolved within the liquid first suppression agent, and when the fire suppression system is in the active state, the storage container and the at least one canister are fluidly connected, and a propellant pressure in the piping system is generally greater than the storage pressure of the fire suppression agent such that when the fire suppression agent is provided to the at least one nozzle, the first pressurized gas remains at least partially dissolved within the fire suppression agent.

2. The fire suppression system according to claim 1, wherein when the fire suppression system is active, the pressurized fire suppression agent and the first pressurized gas at least partially dissolved within the fire suppression agent flow through the piping system to the at least one nozzle in a substantially single-phase flow.

3. The fire suppression system according to claim 1, wherein the first pressurizing gas and the second pressurizing gas may be one of nitrogen, argon, carbon dioxide, or a mixture thereof.

4. The fire suppression system according to claim 1, wherein the fire suppression agent may be one of FK-5-1-12, 1,1,1,2,2,4,5,5,5-nonafluoro-4-(trifluoromethyl)-3-pentanone ($CF_3CF_2C(=O)CF(CF_3)_2$), CAS 756-13-6; HFC-227ea, 1,1,1,2,3,3,3-heptaflurorporpane ($CF_3CHFCF_3$), CAS 431-89-0; HFC-125, 1,1,1,2,2-pentafluoroethane, CAS 354-33-6; HFC-236fa, 1,1,1,2,2,2-hexafluoropropane ($CF_3CHFCF_2H$), CAS 690-39-1.

5. The fire suppression system according to claim 1, wherein the storage pressure of the fire suppression agent is between about 1 psig and about 250 psig.

6. The fire suppression system according to claim 5, wherein the storage pressure of the fire suppression agent is between about 20 psig and about 150 psig.

7. The fire suppression system according to claim 1, wherein the piping system further includes:

a first pipe extending between the storage container and the at least one nozzle, the first pipe having a first valve therein; and a second pipe extending between the at least one canister and the storage container, the second pipe have a second valve therein.

8. The fire suppression system according to claim 7, wherein when the first valve and the second valve are substantially closed, the fire suppression system is inactive.

9. The fire suppression system according to claim 7, wherein when the first valve and the second valve are substantially open, the fire suppression system is active.

10. The fire suppression system according to claim 7, wherein the fire suppression system further includes:

a fire detection device configured to detect a fire; and a controller operably coupled to the fire detection device, the first valve and the second valve, the controller being configured to operate the first valve and the second valve in response to a signal from the fire detection device indicating a fire.

11. A method of reducing a two-phase flow in a fire suppression system comprising:

storing a fire suppression agent within a storage container at a storage pressure greater than a vapor pressure of the fire suppression agent such that a first pressurized gas is at least partially dissolved within the fire suppression agent, the first pressurized gas being distinct from the fire suppression agent;

storing a second pressurized gas within at least one canister;

detecting a fire;

transforming the fire suppression system from an inactive state to an active state by operating at least one valve in a piping system of the fire suppression system, wherein in the active state, the storage container and the at least one canister are fluidly connected;

creating a propellant pressure in the piping system such that the fire suppression agent flows through the piping system to at least one nozzle, the propellant pressure being generally greater than the storage pressure of the fire suppression agent such that when the fire suppression agent is provided to the at least one nozzle, the first pressurized gas remains at least partially dissolved within the fire suppression agent; and expelling the fire suppression agent and the first pressurizing gas at least partially dissolved therein into a space where the fire was detected.

12. The method according to claim 11, wherein the storage pressure is greater than a vapor pressure of the fire suppression agent.

13. The method according to claim 11, wherein the fire suppression agent and the first pressurized gas at least partially dissolved within the fire suppression agent flow through the piping system to the at least one nozzle in a substantially single-phase flow.

14. The method according to claim 11, wherein the piping system fluidly couples the at least one canister to an inlet of the storage container, and fluidly couples an outlet of the storage container to the at least one nozzle.

15. The method according to claim 11, wherein at least one fire detection device of the fire suppression system is configured to emit a detection signal in response to a fire.

16. The method according to claim 15, wherein a controller of the fire suppression system is operably coupled to the at least one fire detection device and the at least one valve of the piping system, the controller being configured to operate the at least one valve in response to receiving the detection signal from the at least one fire detection device.

17. The method according to claim 16, wherein the operation of the at least one valve releases the second pressurized gas into the piping system to generate a propellant pressure.

18. A method of reducing an amount of two-phase flow of a fire suppression agent and a first pressurized gas provided to at least one nozzle of a fire suppression system comprising:

storing a fire suppression agent within a storage container at a storage pressure greater than a vapor pressure of the fire suppression agent such that a first pressurized gas is at least partially dissolved within the fire suppression agent the first pressurized gas being distinct from the fire suppression agent;

storing a propellant gas within at least one canister; and transforming the first suppression system from an inactive state to an active state by operating a valve, wherein in the active state, the storage container and the at least one canister are fluidly connected;

creating a propellant pressure in a piping system coupling the storage container to the at least one nozzle to move the fire suppression agent and the first pressurized gas at least partially dissolved within the fire suppression agent towards the at least one nozzle, the propellant pressure being generally greater than the storage pressure of the fire suppression agent such that at least a portion of the first pressurized gas remains dissolved within the fire suppression agent when the fire suppression agent reaches the at least one nozzle.

19. The method according to claim 18, wherein the fire suppression agent and the first pressurized gas at least partially dissolved within the fire suppression agent flow through the piping system to the at least one nozzle in a substantially single-phase flow.

20. The method according to claim 18, wherein the storage pressure is greater than a vapor pressure of the fire suppression agent.

* * * * *